United States Patent [19]

Domkowski

[11] 4,291,831

[45] Sep. 29, 1981

[54] SECURITY HOUSING

[75] Inventor: Ronald A. Domkowski, Arlington Heights, Ill.

[73] Assignee: Honor Gard, Inc., Chicago, Ill.

[21] Appl. No.: 53,638

[22] Filed: Jun. 29, 1979

[51] Int. Cl.[3] ..... G07B 15/00

[52] U.S. Cl. ..... 232/15; 232/66

[58] Field of Search ..... 232/15, 16, 66; 70/417

[56] References Cited

U.S. PATENT DOCUMENTS

| | | | |
|---|---|---|---|
| 1,411,898 | 4/1922 | Augenbraun | 70/417 |
| 1,983,089 | 12/1934 | Knee | 232/15 |
| 3,033,442 | 5/1962 | Erlichman | 232/15 |
| 3,653,586 | 4/1972 | Bonneson | 232/15 X |
| 3,677,461 | 7/1972 | Nitschneider | 232/15 |
| 3,807,627 | 4/1974 | Nitschneider | 232/66 X |
| 3,807,628 | 4/1974 | Bock | 232/16 |
| 3,974,961 | 8/1976 | Dominick et al. | 232/16 |

*Primary Examiner*—Roy D. Frazier
*Assistant Examiner*—Peter A. Aschenbrenner
*Attorney, Agent, or Firm*—Hume, Clement, Brinks, Willian & Olds, Ltd.

[57] ABSTRACT

A security system for use with a coin container and a coin-processing machine having improved tamper-proof features. The system includes key means in a machine housing which engages with lock means associated with the container. Relative rotation of the lock with respect to the key positively locks the container, to protect coins in the container from pilferage. High-strength mounting means join the key stem to the housing so that the key stem is firmly fixed from rotation which would otherwise override the security of the system.

5 Claims, 9 Drawing Figures

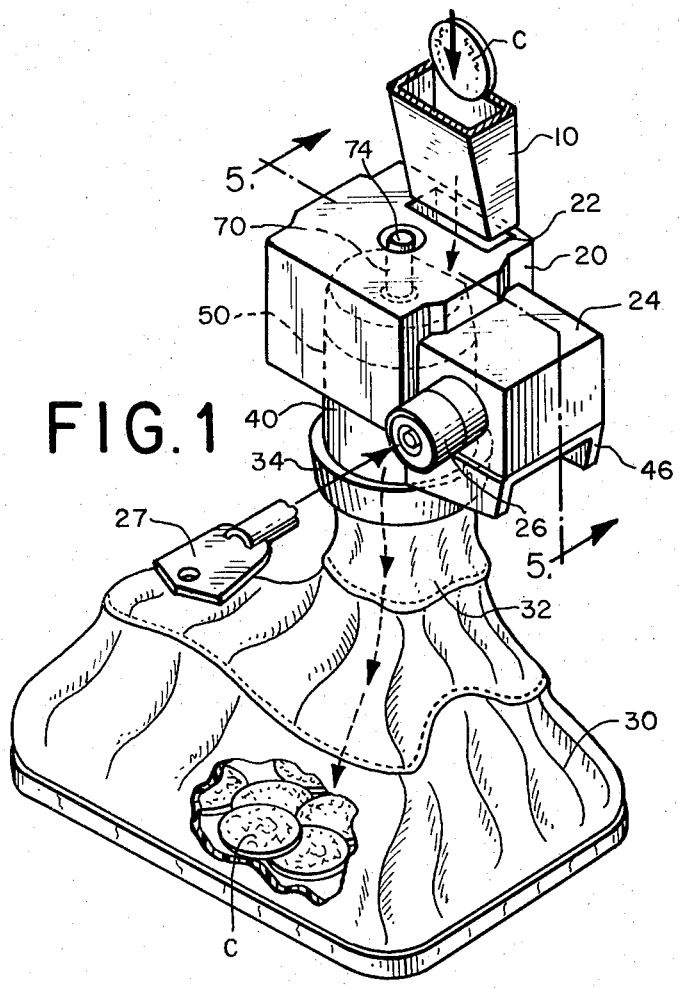
FIG. 1
FIG. 2
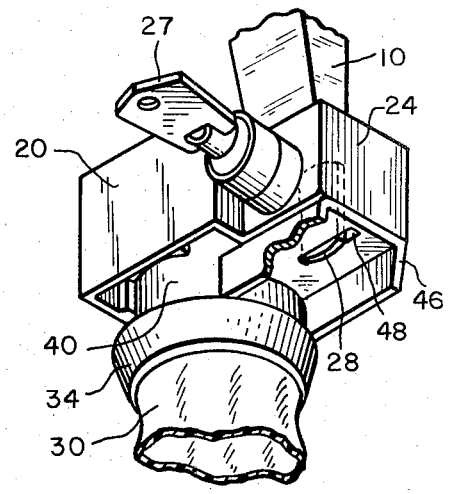
FIG. 4
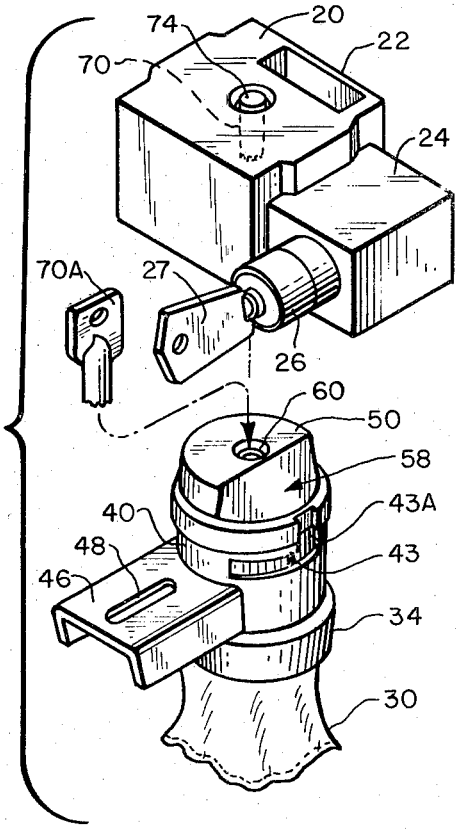
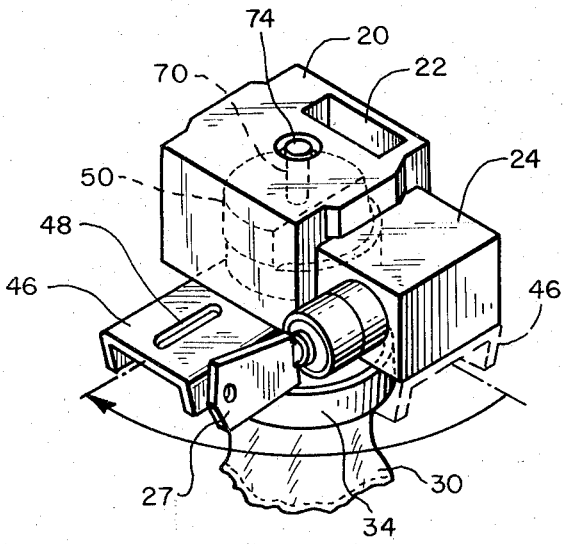
FIG. 3

SECURITY HOUSING

BACKGROUND AND SUMMARY OF THE INVENTION

This invention relates in general to improvements in coin-operated vending machines, and more particularly relates to an improved housing and interlocking structure to enhance the security of the money storage and collecting components of vending machines.

A security system for use in coin-operated merchandising machines is fully described in U.S. Pat. No. 3,807,627 issued on Apr. 30, 1974 for "Simplified Security Device" and presently assigned to the same assignee as the present invention.

As explained generally in said patent, in coin-operated vending machines coins are deposited and a selection of merchandise is made. The coins pass through a series of stations in the machine which totalize and register a credit for the particular item of merchandise. Then the coins pass to a storage and collection receptacle, such as a coin box or coin bag. Typically, a coin-operated vending machine is serviced by one or more routemen, who periodically visit the machine and replenish the supply of merchandise and collect the money which has been accepted and stored by the machine. In some installations different personnel service the merchandise supply and collect the money.

A serious problem has developed in the industry concerning the pilferage of money by routemen or other persons having knowledge of or access to the interior of the machines. This pilferage generally has been accomplished, by persons who have access to the interior of the machine, by tampering with or damaging the machine in a way that covers up the machine failure. Since a number of individuals may be collecting money from the same machine or may have keys to gain access to the machine, it is difficult to pinpoint the source of any such tampering or pilferage. Also, some design characteristics of the machines have made it possible for a person having knowledge of the machines to selectively override the security features built-in to the machine.

The coin collection system illustrated in the above-noted patent is one example of a system which has been subject to tampering and pilferage. In that system, a coin bag having a coin-receiving mouth is removably attached to a housing in the vending machine. The housing attached to the vending machine is provided with a key stem which mates with a lock on the coin bag This key stem is arranged so that a given rotation of the coin bag, to mount the bag in the vending machine, opens the coin bag. This allows the bag to receive coins when the machine is operated. Similarly, the housing key stem is adapted to close the mouth of the bag, to seal the coins in the bag, when a route man rotates the bag to remove it from the machine.

The locking of the coin bag is an obvious necessity to assure security. If the bag is not closed in a tamper-proof manner, the coins can be readily removed by the route man, or others. The bag is opened only with a key which corresponds to the key stem. This key is normally held by the accountant in the home office which receives the coin bags collected by the route men.

Field experience has shown that dishonest route men, machine service men, or other persons having access to the interior of the machines, can override the security provided in the above-described system. One way in which security is overriden is by tampering with the housing key stem described above, so that the key stem rotates with the rotation of the bag. In this manner, the normal closing of the bag, caused by the key stem, will not occur when the bag is removed from the housing. Hence, the bag can be removed in an open, unlocked condition, and the coins in the bag are accessible to pilferage.

Accordingly, the present invention is designed to provide a security system for releasibly coupling a coin bag to a housing in a vending machine in a manner which minimizes the possibility of pilferage by tampering with the key stem in the machine housing. Hence, the invention increases the likelihood that the coin bag will be removed from the housing in the proper closed position. In accordance with this invention, this improved security system strengthens the resistance of the housing key stem to tampering and pilferage, while at the same time permitting the housing to be made from relatively inexpensive materials.

DESCRIPTION OF A PREFERRED EMBODIMENT

Further objects and features of the present invention will become apparent from the following description of an illustrative embodiment of the invention, as shown in the accompanying drawings, wherein:

FIG. 1 is a top perspective view of the coin bag mounted in the machine housing in accordance with the present invention;

FIG. 2 is a bottom perspective view of the coin bag in the machine housing, showing the interlocking arrangment between the machine housing and the bag components when the bag is locked in the coin-receiving position;

FIG. 3 is a perspective view of the components shown in FIG. 2, illustrating the machine housing and the components of the coin-receiving bag in an unlocked position;

FIG. 4 is an exploded perspective view of the housing and the coin bag components arranged in an unlocked position;

Figure 5:
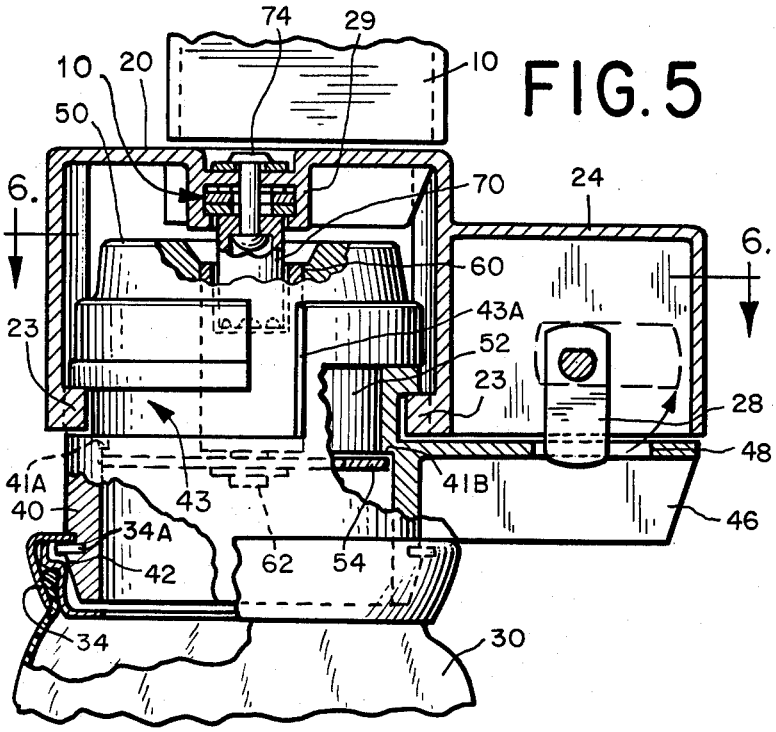
FIG. 5 is a cross-sectional view of the housing and coin bag components arranged in a locked position, taken along the line 5—5 in FIG. 1.

Referring generally to the drawings, a coin vending mechanism is provided with a coin inlet generally indicated by the reference numberal 10, for receiving a coin C. This inlet 10 mates with a opening 22 provided in a removable machine housing 20. The housing 20 is installed within the vending machine, and is adapted to receive and secure a coin bag 30 within the machine. The narrow upper mouth portion 32 of the coin bag 30 carries a retaining ring 34A. The retaining ring 34A secures a generally cylindrically-shaped mounting and locking member 40 to the top part of the bag 30. As seen in section in FIG. 5, a circular groove 42 on the lower portion of the member 40 receives the retaining ring 34A, and joins the member 40 to the bag 30. The elastic cord stock; 34, sewn to the neck of the bag prevents seperation of the bag from member 40.

A lateral extension 46 of the member 40 extends to the side of the bag 30, such as shown in FIG. 3. This extension 46 projects beneath a key box 24 of the machine housing 20, when the bag 30 is mounted in its operating position within the housing 20. The key box 24 includes an operating key lock 26, such as described in said U.S. Pat. No. 3,807,627. This key lock 26 is operated by a route man during the installation and removal of the bag 30 from the machine. a lower position, as in FIGS. 2 and 5. The extension 46 includes a lateral slot 48 which receives the tab 28. The tab 28 thereby prevents the bag 30 from being rotated with respect to the machine housing 20 when the assembly is in this locked position.

As seen in FIG. 5, the member 40 includes a pair of L-shaped locking grooves 43, which include a vertical groove portion 43A. The grooves 43, 43A receive a pair of opposed tabs 23 provided on the inside surface of the machine housing 20. To insert the bag 30 into the machine housing 20, the groove portions 43A are aligned with the tab 23, and the member 40 is moved upwardly with the housing 20. Then the member 40 and the bag 30 are rotated approximately 90°, with the housing tabs 23 sliding within the grooves 43. This rotation is continued until the lateral extension 46 aligns with the locking box 24. The tab 28 of the key lock 26 then can be moxed downwardly into a locking position within the slot 48 on the extension 46. Hence, the tabs 23 and the locking grooves 43 cooperate with the locking tab 28 to prevent the bag 30 and the member 40 from being removed from the housing 20, after the member 40 is locked in place.

The security system in accordance with this invention also includes a cylindrical locking cap 50 for installation with the member 40. This locking cap 50 is designed to selectively lock the mouth of the bag 30, so that the bag cannot be emptied by the route man or others during the coin collection process. The locking cap 50 is also designed to automatically open the mouth of the bag 30 as the bag 30 and the member 40 are installed within the vending machine housing 20. Likewise, the cap 50 automatically locks the mouth of the bag 30 closed when the bag 30 and the member 40 are removed from the machine housing 20.

As seen in FIG. 5, the inside surfaces of the member 40 include two abutment shoulders 41A and 41B. The lower portion 52 of the cap 50 is machined for fitting within the opening of the bag member 40 in engagement with the shoulders 41A and 41B. By this arrangement, the shoulders 41A and 41B prevent the rotation of the cap 50 within the member 40.

Figure 6:
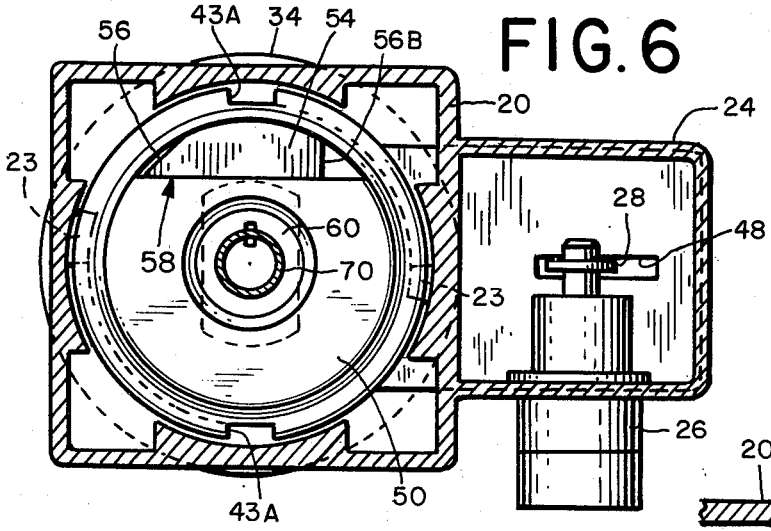
FIG. 6 is a cross-sectional view of the housing and bag components taken along the line 6—6 in FIG. 5.
Figure 7:
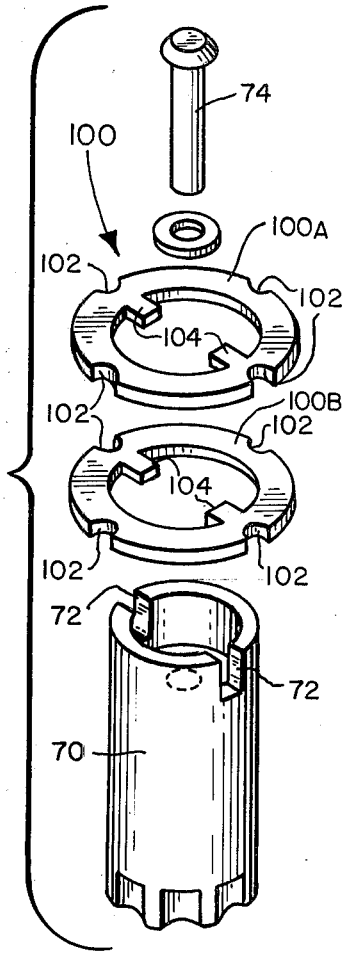
FIG. 7 is a removed exploded view of the improved insert assembly for mounting the key stem within the machine housing.

A rotatable locking plate 54 is secured to the bottom portion of the keylock 60. This plate 54 is rotatable between an unlocked position, as shown in FIG. 7 and a locked position, as shown in FIGS. 3 and 7. The plate 54 includes side edges 56, as seen in FIG. 6, which allow the plate to be inserted into the member 40 over the shoulders 41A and 41B. When the plate 54 is in an unlocked position, the plate 54 includes an additional edge 56B, which defines a coin-receiving aperture. In the unlocked position, the edge 56B is arranged in alignment with a coin-receiving opening 58 provided in the cap 50. The unlocked position of the plate 54 thus allows coins to be transmitted through the housing aperture 22, and through the cap opening 58, into the bag 30. Furthermore, the unlocked position for the plate 54, allows the locking cap 50 to be removed from the member 40, for discharging the coins from the bag 30.

The locked position for the plate 54 is approximately 90° out-of-phase with respect to the unlocked position. In this locked position, as shown in FIGS. 5 and 6, the plate 54 blocks the opening 58 in the locking cap 50 so that coins cannot pass through the opening. In the locked position, the plate 54 also engages underneath the shoulders 41A and 41B on the member 40, as shown in FIG. 5. Accordingly, the locking cap is locked on the bag member 40, and the locking plate 54 locks the coin-receiving opening 58 in the cap 50 closed.

As shown in FIGS. 4–5, the mechanism provided on the locking cap 50 for actuating the plate 54 between the abovedescribed locked and unlocked positions in a key lock 60. The key lock 60 is connected to a drive shaft 62 which, in turn, is fixed to the locking plate 54 (FIG. 5). Rotation of the internal locking components of the lock 60 produces a corresponding rotation of the plate 54. This lock 60 is adapted to receive and be actuated by a cylindrical key stem 70 (FIG. 5), or by a comparable separate cylindrical key 70A (FIG. 4).

Figure 8:
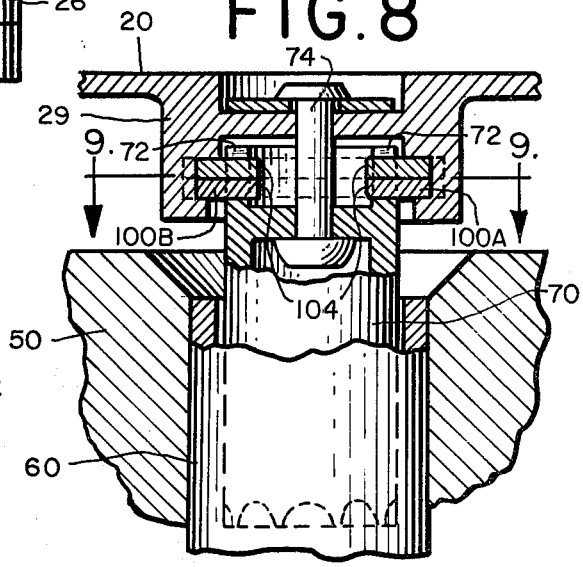
FIG. 8 is an enlarged partial cross-sectional view of the insert assembly and key stem provided in the machine housing.

As shown in FIGS. 5 and 8, the key stem 70 is firmly mounted in the central portion of the machine housing 20. The key stem 70 is inserted within the key lock 60, as the cap 50 is placed within the housing 20. Further, the key stem 70 is fixed from rotation, so that the rotation of the cap 50 within the housing 20 activates the key lock 60 and correspondingly rotates the connected locking plate 54.

In the operation of the security system, the bag 30 is opened in a safe location, such as by the accounting department after a route man has turned in the bag, by inserting the key 70A into the lock 60 and rotating the key 90°. This releases the plate 54 from the shoulders 41A and 41B and permits the locking cap 50 to be removed from the member 40. The coin contents of the bag 30 can now be emptied and totalized. In practice, keys such as the key 70A are not made available to route men or others, but only to select authorized personnel, such as in the home office accounting department. In this manner, the bags 30 are locked closed during transit, and cen be unlocked only in the secure confines of the home office.

The lock 60 and key stem 70 also operate to open the bag 30 automatically as the bag is installed in the machine housing 20. The orientation of the key stem 70 is coordinated with the positioning of the tabs 23 on the housing 20, so that the key stem will be received within the lock 60 as the tabs 23 are received within the vertical grooves 43A on the member 40. Then, rotation of the bag member 40 with respect to the machine housing 20, and the sliding of the tabs 23 within the grooves 43A, simultaneously rotates the lock 60 with respect to the fixed key stem 70. The stationary key stem 70 causes the key lock 60 to activate the plate 54 and move the plate from a closed position to an opened position, as described above. The route man key 27 now can be activated to engage the tab 28 in the slot 48 and thereby lock the member 40 and bag 30 in the housing 20.

When the bag 30 is removed from the machine housing 20, the above-described operation is reversed. The counter-rotation of the bag member 40, and the corresponding rotation of the lock 60 caused by the fixed key stem 70, moves the plate 54 closed, to block the opening 58 of the cap and simultaneously lock the plate 54 under the shoulders 41A and 41B on the bag housing 40.

It is evident from the above description of the operation of the security system that it is critical that the key stem 70 remain stationary within the machine housing 20. If the key stem 70 can be rotated as the locking cap 50 is rotated, the security of the system would be defeated. The bag 30 then could be removed from the housing 20 in an unlocked condition, and the money in the bag stolen. In some prior commercial installations, it has been discovered that the key stem 70 could be rendered rotatable with the use of simple manual tools. For ease of manufacture and economy in cost, the housings 20 are preferably made from a relatively frangible material, such as a die cast metal. In some of these prior installations rotation of the key stem 70 in the housing 20 has been prevented only by portions of the frangible die cast metal housing. In this arrangement, it has been found that the key stem 70 can be rotated, to shear the die cast metal portions restraining it from rotation, upon the application of a relatively low force couple in the range of 25 inch pounds. The application of that force couple is possible by inserting a screwdriver, or other mechanical tool, within the key stem 70 and rotating the tool. In fact, larger force couples up to 100 inch pounds can be applied to the key stem 70 with a screwdriver. Accordingly, the key stem 70 could be rendered rotatable, and the security system built into the vending machine thereby overridden with relative ease.

In accordance with this invention, the key stem 70 and the housing 20 are modified to greatly strengthen the components which prevent rotation of the key stem 70 with respect to the housing. As shown in particular in FIGS. 7 and 8, this improved connection between the key stem 70 and the housing 20 is accomplished by providing the central portion of the housing 20 with a strengthened mounting insert 100 constructed from relatively high-strength material. For example, the insert 100 is preferably made from heat-treated steel which has substantial shear strength compared to the die-cast material from which the housing 20 is preferably constructed.

In the illustrated embodiment, the mounting insert 100 comprises a pair of heat-treated steel cylindrical inserts 100A and 100B. These inserts 100A and 100B are cast in-place within a boss 29 which is cast in the central portion of the housing 20. As shown in FIG. 7, the outer periphery of each of the inserts 100A and 100B includes a plurality of equally spaced recesses 102. These recesses 102 are filled with the material of the boss 29 during the casting of the housing 20. Hence, the resistance of the boss and housing material within the recesses 102 prevents the inserts 100A and 100B from rotating within the boss 29.

Figure 9:
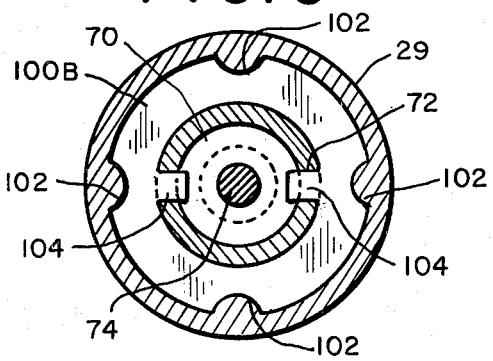
FIG. 9 is a cross-sectional view of the connection between the mounting insert and the key stem, as viewed along the line 9—9 in FIG. 8.

As also seen in FIGS. 7, 8 and 9, the interior surface of each insert 100A and 100B includes a pair of abutment tabs 104. These tabs 104 project inwardly, and are designed for insertion within vertical grooves 72 in the key stem 70. A rivet 74 firmly secures the stem 70 in the above-described position within the central boss 29 of the housing 20.

With this arrangement, the key stem 70, which preferably is made from a relatively high-strength steel, is secured in place within a relatively frangible housing 20 by direct engagement with the relatively high-strength abutment tabs 104 provided by the inserts 100A and 100B. The high-strength inserts 100A and 100B, through the tabs 104, positively prevent the rotation of the key stem 70 with respect to the housing 20. This invention thereby allows an economical die cast housing 20 to be used in vending machines, while at the same time rendering the housing relatively tamperproof. Due to the engagement of high-strength components 100A and 100B and 70, it is no longer possible to easily override the security of the system by forcibly turning the key stem 70 within the housing 20.

Although the invention has been described above with a certain degree of particularity, it should be understood that this disclosure has been made only by way of example. Consequently, numerous changes in the details of construction and in the combination and arrangement of the components, as well as in the possible modes of utilization in accordance with this invention will be apparent to those familiar with the art, and may be resorted to without departing from the scope of the invention.

What is claimed is:

1. In a security system for releasably mounting a coin-collecting container in a coin processing machine, the improvement comprising:

a mounting member removably attached to said container including a coin-receiving aperture for directing the coins into said container;

rotatable closure means movable on said member between an opened position, allowing the coins to pass through said aperture, and a closed position blocking the passage of coins through said aperture;

locking means on said member for selectively locking said closure means in said opened or closed positions and for driving said closure means therebetween;

a housing adapted for connection to said coin processing machine and further adapted to releasably connect said mounting member and the associated container to said machine, said housing including means for receiving coins processed by said machine and directing the coins into said container through the aperture in said mounting member;

key means provided on said housing and engagable with said locking means on said member, as said member is inserted in and rotated with respect to said housing, to drive said closure means of said member between said opened and closed positions, so that rotation of said member within said housing a selected degree moves said closure means from a closed position to an opened position and thereby permits coins to be deposited in said container through said member;

said key means being further engagable with said locking means to rotate said closure member into said closed position as said member is rotated in a counter-direction with respect to said housing, so that the removal of said member from said housing closes said closure member and retains the coins within said container associated with said member; and high-strength insert means integrally joined within said housing member and firmly connecting said key means in a non-rotatable position is said housing, said insert means including outer detents on its periphery for engagement with said housing, to prevent rotation of said insert, and further including inner detent means projecting inwardly and engaged with said key means to positively prevent relative rotation of said key means with respect to said housing.

2. A security system in accordance with claim 1 wherein said insert means comprises at least one high-strength plate mounted integrally within said housing, with said plate including detents on its outer periphery for engagement with said housing, to prevent relative rotation of said insert, and shear-resistant tab means projecting inwardly from said insert and engaged with said key means, to positively prevent relative rotation of said key means with respect to said housing.

3. A security system in accordance with claim 2 wherein said lock means comprises a cylinder lock and said key means comprises a cylindrical key and further wherein said insert means comprises a pair of plate washers engaged between said housing and said cylindrical key.

4. A security system in accordance with claim 2 wherein said housing is formed from a die-cast material and said insert means are cast within said die-cast material and are formed from a material having a shear strength substantially greater than said die-cast material.

5. A security system in accordance with claim 4 wherein said insert means are formed from high shear strength steel.

* * * * *

UNITED STATES PATENT AND TRADEMARK OFFICE

CERTIFICATE OF CORRECTION

PATENT NO. : 4,291,831

DATED : Sept. 29, 1981

INVENTOR(S) : Domkowski, Ronald A.

It is certified that error appears in the above—identified patent and that said Letters Patent is hereby corrected as shown below:

Column 2, line 46, after "FIG. 1" please delete the period and substitute therefor a semicolon;

Column 2, line 60, please delete "numberal" and substitute therefor the word --numeral--;

Column 3, lines 14 and 15, please delete "a lower position, as in FIGS. 2 and 5.";

Column 3, line 31, please delete "moxed" and substitute therefor --moved--;

Column 4, line 17, please delete "abovedescribed" and substitute therefor --above-described--;

Column 4, line 46, please delete "cen" and substitute therefor --can--;

Column 6, line 4, please delete "tamperproof" and substitute therefor --tamper-proof--;

Column 6, line 63, please delete "is" and substitute therefor --in--.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*